United States Patent [19]

Raetz et al.

[11] 3,952,951

[45] Apr. 27, 1976

[54] APPARATUS FOR ELECTROSTATICALLY COATING OBJECTS WITH LIQUID, SOLID IN LIQUID, AND/OR POWDER-LIKE MATERIAL

[75] Inventors: Dieter Raetz, Neckarweihingen; Fred Luderer, Weiler zum Stein, both of Germany

[73] Assignee: Firma Ernst Mueller K.G., Winnenden, Germany

[22] Filed: Mar. 3, 1975

[21] Appl. No.: 554,495

[30] Foreign Application Priority Data

Mar. 13, 1974 Germany ..... 2412131

[52] U.S. Cl. ..... 239/15; 239/105; 239/291

[51] Int. Cl.[2] ..... B05B 5/02; B05B 1/28

[58] Field of Search ..... 239/3, 15, 104, 105, 239/106, 112, 113, 290, 291, 295, 296, 297, 299

[56] References Cited

UNITED STATES PATENTS

| | | | |
|---|---|---|---|
| 2,890,388 | 6/1959 | Croskey et al. | 239/15 UX |
| 2,896,571 | 7/1959 | Geertsen | 239/105 X |
| 2,959,353 | 11/1960 | Croskey et al. | 239/15 |
| 3,136,484 | 6/1964 | Dittrich | 239/295 X |
| 3,169,882 | 2/1965 | Juvinall et al. | 239/3 X |
| 3,296,015 | 1/1967 | Juvinall et al. | 239/15 X |
| 3,463,395 | 8/1969 | Binoche | 239/296 X |
| 3,635,401 | 1/1972 | Bromley et al. | 239/15 |
| 3,692,241 | 9/1972 | Walberg | 239/15 |
| 3,764,068 | 10/1973 | Lacchia | 239/3 |
| 3,837,573 | 9/1974 | Wagner | 239/15 |

*Primary Examiner*—Robert S. Ward, Jr.
*Attorney, Agent, or Firm*—Burns, Doane, Swecker & Mathis

[57] ABSTRACT

An electrostatic coating nozzle provided with air jet means for preventing fouling of the nozzle electrode and electrode housing.

2 Claims, 3 Drawing Figures

APPARATUS FOR ELECTROSTATICALLY COATING OBJECTS WITH LIQUID, SOLID IN LIQUID, AND/OR POWDER-LIKE MATERIAL

BACKGROUND OF THE INVENTION

The invention relates to an arrangement for the electrostatic coating of objects with liquid or powdery coating material.

According to a previous concept, such an arrangement consists of a hollow pipe, an atomizer nozzle fed with coating material by a supply line running through the barrel of the gun and located at the termination of the gun barrel, an electrode for charging the atomized material, which electrode is connected to a high voltage source by way of a current-limiting resistor and a high voltage cable running through or on the gun barrel, and an elongated body of insulating material running essentially parallel to the longitudinal axis of the gun barrel, which body is attached on the gun barrel and carries the electrode (preferably a metal needle, the free end of which is located at a distance from the nozzle of the gun barrel.

The atomizer gun according to this previous concept, (as disclosed in Luderer et al. U.S. patent application Ser. No. 456,827, filed Apr. 1, 1974, entitled "Improvements in Electrostatic Coating" and the disclosure of which is herein incorporated by reference) is distinguished by providing a particularly good electric charge for the coating material, even whenever the coating material has a relatively high conductivity as is the case especially with the modern water paints. In practice, however, it turned out that, especially in the case of an extended operation of the spraying gun, fouling of the electrodes as well as of the electrode carrier can occur as a result of particles of the color pigment. It is true that the electrode of this earlier concept is not directly in the jet of paint emanating from the atomizer nozzle. However, as a result of the arrangement of the electrode at a distance in front of the atomizer nozzle, one cannot prevent individual particles of the color pigment from reaching the electrode or the electrode carrier. Thus, after a certain time, a film of coating material will develop on these elements. Therefore, it was necessary to clean the gun at certain intervals. This leads to short interruptions of the operating process.

SUMMARY OF THE INVENTION

Therefore, the present invention is based on the task of continuing to develop spray guns of the initially mentioned type, where the electrode is located at a distance in front of the atomizer nozzle, in such a way that the danger of fouling of the electrode or of the electrode carrier will be avoided. This task is solved, according to the invention, by a blowing or jetting nozzle fed with compressed air, the blowing or jetting aperture of which is directed essentially onto or along the electrode or between the electrode and the atomizing spray.

According to the invention therefore, the electrode lies in the area of a jet of blown air, as a result of which it will be guaranteed that no color pigment particles can be deposited on the electrode or on the area of the electrode carrier adjacent to said electrode.

In the case of the so-called high pressure guns, where atomization itself takes place without the use of compressed air, one must provide according to the invention a compressed air supply line for the blowing or jetting nozzle running through or on the gun barrel and connected with a supply of compressed air. In the case of spray guns where atomization of the coating material is accomplished by use of compressed air, the blowing or jetting nozzle can be connected by way of a branch line with the supply line providing the compressed air used for atomization.

The invention will now be explained in more detail on the basis of the drawings.

DRAWINGS

In describing the invention, by way of example but not limitations, reference will be made to preferred embodiments shown in the appended drawings.

DETAILED DESCRIPTION

Figure 1:
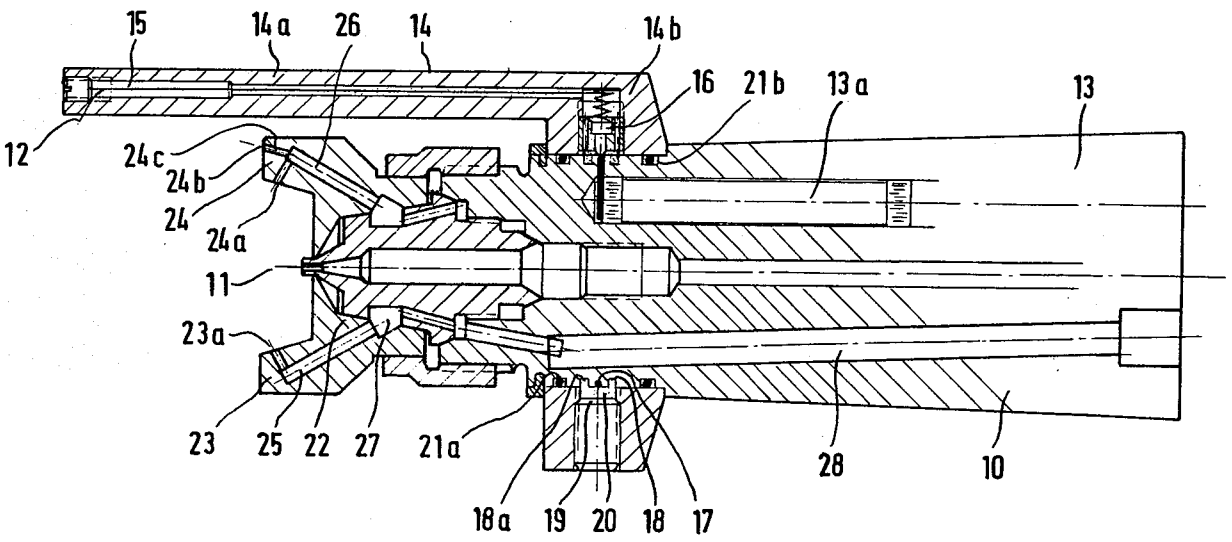
FIG. 1 shows a side view, partially in section of the frontal area of a hand spray gun according to a first embodiment of the invention.

In the case of the spraying arrangement according to FIG. 1, there is shown an arrangement where the atomization takes place with the aid of compressed air and where a flat jet of atomized material such as paint is formed by way of known "air horns," i.e. opposed air jets.

The gun barrel 10, consists of insulating material. Gun barrel 10 includes nozzle 11. During operation the coating material, which may comprise color pigment, is ejected. The high voltage electrode 12 is actuated by a high voltage supply line 13. Line 13 has a high resistance, current-limiting resistor **13*a* and runs through the gun barrel 10**, as generally shown.

An electrode body or housing 14 is formed of insulating material and consists of an elongated, approximately cylindrical part **14*a* and a base 14*b* in the general form of a ring which may be integral with part 14*a*. The base 14*b* of body 14 is slipped onto the barrel 10 such that body 14** is rotatable around its longitudinal axis.

In the body 14 there is an electrical conductor 15 connected with the electrode 12, which conductor 15 is connected in the annular base **14*b* with a spring-loaded contact button 16. The contact button 16, by means of spring pressure, touches an electrically conductive ring 17 recessed into the periphery of the gun barrel 10. Ring 17 is connected with the high voltage supply line 13**.

On both sides of the conductive ring 17, annular grooves **18*a* and 18*b* are formed into the periphery of the gun barrel 10. These annular grooves, together with an annular recess 19 in the base 14*b*, provide an annular chamber 20. The annular chamber 20 is filled with saponified transformer oil. For the purpose of sealing the chamber 20, there are two additional annular grooves 21*a* and 21*b* provided in the gun barrel 10**, which grooves contain annular sealing gaskets, such as "O" rings.

As earlier mentioned, in the case of the apparatus shown in FIG. 1, compressed air is used for the atomization of the material to be dispensed.

The head 22 of the jet unit, which surrounds (i.e., is telescoped over) the atomizing nozzle 11, operates to form a flat jet of atomized material. For this purpose, head 22 includes two horns or appendages 23 and 24. These appendages are provided with opposed air nozzles 23*a* and 24*a* and which form opposed air jets which compress the jet of color pigment emerging from nozzle 11 into a flattened configuration. The air nozzles 23*a* and 24*a* are connected, by way of connecting passages 25 and 26 with an annular channel 27. This channel 27 is supplied with compressed air by a compressed air line 28 running through the gun barrel 10.

In the arrangement according to FIG. 1, the flattened spray or jet issuing from nozzle 11 lies in flattened alignment with a plane perpendicular to the plane of the paper. The electrode 12 is located, as shown, radially outside of the location of this flat jet, i.e., in alignment with a plane which is perpendicular to the plane of the flat jet and which passed longitudinally through the nozzle 11. Whenever the head 22 is rotated in relation to the gun barrel 10, then the body of insulating material 14 and thus the electrode 12 should also be rotated to maintain the alignment where the electrode 12 will again lie outside the plane of the flat jet. However, while the electrode 12 will thus always be outside of the flat jet, the danger still exists that the electrode 12 will be fouled.

According to this invention, the gun has a blowing nozzle or jet outlet 24*b* located on the horn or appendage 24, generally adjacent to the electrode 12. The flowing or jetting aperture 24*b* is directed toward the electrode 12 and is connected by way of a branch passage 24*c* with the connecting passage 26 which supplies the atomizer nozzle 24*a* with compressed air.

In this manner, the electrode 12 and the front area of the body 14*a* of insulating material, adjacent to the electrode, are continuously located in a stream or jet of blown air during the spraying operation, and this stream prevents the deposit of color pigment particles on the electrode and body 14*a*. Even in the case of a prolonged operation of the gun, it is therefore not necessary to interrupt the operation for the purpose of cleaning the electrode.

In order to prevent less air being supplied by the atomized nozzle 24*a* than by the nozzle 23*a*, as a result of the branching off of the jetting air to outlet 24*b*, which could lead to a slight deflection of the flattened jet issuing from nozzle 11, it will be effective to provide a compensating means comprising somewhat larger cross section for the supply passage 26 than the corresponding passage 25 feeding air to jet 23*a*.

Another possible compensating arrangement for maintaining this equilibrium could involve the provision of a venting outlet in the horn 23 and communicating into jet nozzle passage 23*a* and/or passage 25.

In the case of types of guns with two electrodes and electrode carriers, arranged in mirror image relation to the atomizer nozzle 11, it is desirable to provide electrode blowing nozzles in both horns so that both electrodes and their carriers will be continuously exposed to a jetting flow of air.

Figure 2:
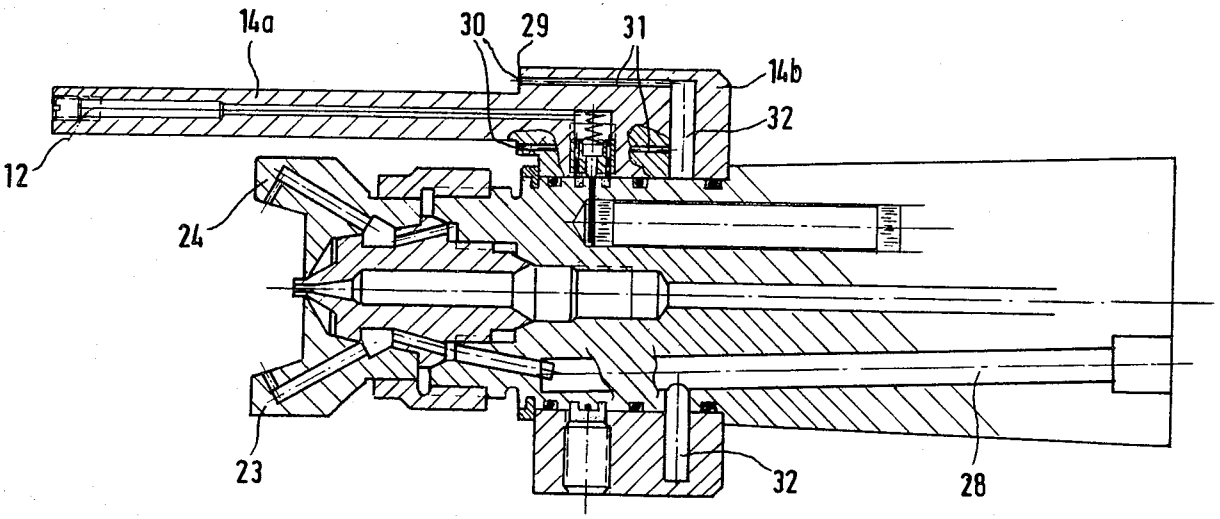
FIG. 2 is a view, generally corresponding to FIG. 1, of a second embodiment of the invention.

A second embodiment of the invention is shown in FIG. 2. In the case of this embodiment, the annular base 14*b* of the body 14 of insulating material carrying the electrode 12 has a forwardly facing, radially projecting annular flange 29. In a mirror image fashion, two blowing nozzles 30 have been arranged radially outwardly of body 14*a* to jet air longitudinally along body 14*a* toward electrode 12. The blowing or jetting apertures of the blowing nozzles 30 are directed essentially parallel in relation to the longitudinal axis of the elongated body 14*a* of insulating material. These two blowing nozzles 30 are connected by way of branch passages 31 with an annular channel 32 to which is fed compressed air from the compressed air line 28.

Instead of only two blowing nozzles 30, more such nozzles can also be provided lying in an annular pattern about body 14*a*. In order to fully surround the elongated body 14*a* of insulating material and the electrode 12 with a coaxial jacket of blown air, an annular outlet 30, encircling body 14*b* may be provided.

Figure 3:
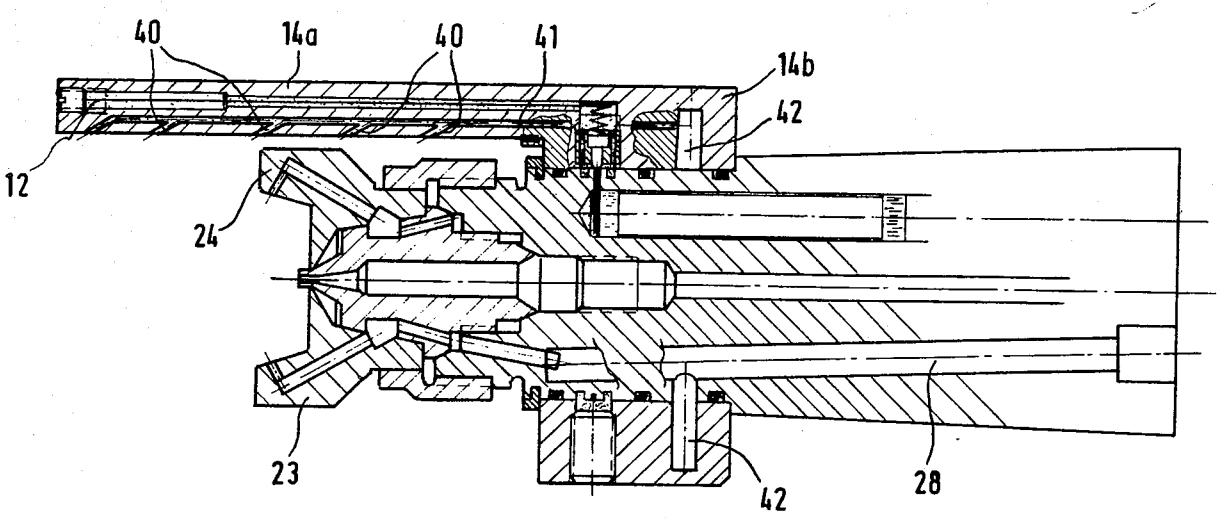
FIG. 3 is a view, generally according to FIG. 1, of a third embodiment of the invention.

In the case of the embodiment according to FIG. 3, several blowing or jetting nozzles 40 are located in the elongated body 14*a* of insulating material. As shown the blowing nozzles 40 are inclined forwardly and toward the jet issuing from nozzle 11 such that a stream of blown air develops which shields the electrode 12. These blowing nozzles 40 may communicate with an annular channel 42 by way of a branch passage 41, which annular channel 42 is supplied with compressed air via the compressed air line 28.

GENERAL ADVANTAGES AND SCOPE OF THE INVENTION

The invention can be used advantageously in case of all electrostatic spray guns whenever the electrode is arranged in such a way that the danger of fouling exists.

Naturally the invention can have numerous modifications, especially as far as the number and arrangement of the blowing nozzles is concerned.

In the case of spray guns where the atomization takes place without the use of compressed air, it will be necessary to provide a special source of compressed air and a feed line for said compressed air. However, even under these circumstances, the arrangement of the electrode shielding, blowing nozzle means can take place in an equivalent manner as in the case of guns which are characterized by compressed air atomization.

In describing this invention reference has been made to preferred embodiments. However, those skilled in the art of this invention and familiar with this disclosure may recognize additions, deletions, substitutions or other modifications which would fall within the scope of this invention which is considered to be defined by the appended claims.

What is claimed is:

1. Apparatus for the electrostatic coating of objects, said apparatus comprising:

gun barrel means atomizer nozzle means;

supply means operable to supply coating material to said atomizer nozzle means;

electrode means operable to charge a spray of dispersed material issuing from said atomizer nozzle means;

high voltage source means operable to charge said electrode means;

body means supporting said electrode means in spaced relation relative to said nozzle means;

blowing nozzle means operable to direct a flow of anti-fouling air into anti-fouling cooperation with said electrode means;

opposed jetting means operable to flatten a flow of material issuing from said atomizer nozzle means;

air supply means operable to transmit air to said jetting means; and means including said air supply means, for diverting air supplied to one of said jetting means to said blowing nozzle means.

2. An apparatus as described in claim 1 including:

compensating means tending to compensate for said diversion of air from said one of said jetting nozzle means and produce equalized flows of air from said opposed jetting means.

* * * * *